US007523899B2

(12) United States Patent
Cormier

(10) Patent No.: US 7,523,899 B2
(45) Date of Patent: Apr. 28, 2009

(54) MOUNTING BLOCK FOR SIGNAGE

(75) Inventor: Paul H Cormier, Sterling, MA (US)

(73) Assignee: Sheldon Distributors LLC, Derry, NH (US)

( * ) Notice: Subject to any disclaimer, the term of this patent is extended or adjusted under 35 U.S.C. 154(b) by 34 days.

(21) Appl. No.: 11/257,530

(22) Filed: Oct. 25, 2005

(65) Prior Publication Data

US 2006/0086878 A1 Apr. 27, 2006

Related U.S. Application Data

(60) Provisional application No. 60/621,630, filed on Oct. 25, 2004.

(51) Int. Cl.
*E04H 17/02* (2006.01)
*G09F 7/02* (2006.01)

(52) U.S. Cl. ..... 248/200; 248/220.21; 40/611.01; 40/583; 256/1; 256/32; 411/111

(58) Field of Classification Search ..... 248/200, 248/220.21, 300; 256/1, 32, 33; 40/611.01, 40/583, 550, 607.15, 622; 411/116, 119, 411/166, 111; 70/208; 52/512
See application file for complete search history.

(56) References Cited

U.S. PATENT DOCUMENTS

| | | | | |
|---|---|---|---|---|
| 1,822,909 | A * | 9/1931 | Schneider | 52/507 |
| 2,448,902 | A * | 9/1948 | McKenzie | 411/265 |
| 2,477,429 | A * | 7/1949 | Swanstrom et al. | 411/111 |
| 2,681,679 | A * | 6/1954 | Poupitch | 411/111 |
| 2,875,804 | A * | 3/1959 | Flora | 411/427 |
| 4,078,754 | A | 3/1978 | Gould | |
| 4,340,144 | A * | 7/1982 | Cousins | 211/106.01 |
| 4,582,284 | A * | 4/1986 | Veenstra | 248/220.21 |
| 4,651,975 | A * | 3/1987 | Howell | 256/32 |
| 4,842,230 | A * | 6/1989 | Cobb et al. | 248/220.21 |
| 5,441,239 | A | 8/1995 | Watson | |
| 5,487,524 | A * | 1/1996 | Bergetz | 248/613 |
| 5,598,753 | A * | 2/1997 | Lee | 411/911 |
| 5,870,934 | A * | 2/1999 | Cullinan | 411/910 |
| 6,592,102 | B2 | 7/2003 | Telles | |
| 6,935,824 | B2 * | 8/2005 | Nowak, Jr. | 411/402 |
| 7,076,898 | B1 * | 7/2006 | Hunt | 40/611.01 |

FOREIGN PATENT DOCUMENTS

| | | |
|---|---|---|
| WO | WO 95/05514 | 2/1995 |

* cited by examiner

*Primary Examiner*—Anita M King
(74) *Attorney, Agent, or Firm*—Vern Maine & Associates

(57) ABSTRACT

Provided is a system for mounting signs, the system having: a mounting block with a sign interfacing boss configured to be received into an aperture in a fence having an anterior surface and posterior rim; the anterior surface being configured to be attached to a sign; and a flange disposed about the posterior rim.

16 Claims, 9 Drawing Sheets

MOUNTING BLOCK FOR SIGNAGE

RELATED APPLICATIONS

This application claims the benefit of U.S. Provisional Application No. 60/621,630, filed Oct. 25, 2004. This application is herein incorporated in its entirety by reference.

FIELD OF THE INVENTION

The invention relates to sign mounting systems and more specifically it relates to a sign and banner mounting fastener for the mounting of rigid or flexible signs to wire fences and solid walls.

BACKGROUND OF THE INVENTION

It is commonplace to find a number of public signs that convey information to the reader. Signage, like banners or rigid billboards, is often affixed to chain link fencing or solid walls. Unfortunately, signs are exposed to thieves and vandals when left unattended, and are easily stolen. Known systems for mounting signs to such surfaces fail to provide tamper resistance. Consequently, such systems are readily compromised by vandals or thieves.

Known systems used to affix signage or other mounted structures to chain link fences and other surfaces include the use of bars or boards through which a plurality of mechanical fasteners, like bolts or screws, may be inserted. Such systems typically do not afford means for preventing the removal of the fastener by unauthorized parties, as both the fastener head and the nut are exposed.

The exposed fasteners and other attachment mechanisms are not only unsightly, but pose a safety risk with sharp edges and protruding fasteners. The present systems for mounting signage are also time consuming and laborious.

Also, with respect to mounting of signs on solid surfaces, a typical requirement is for offset structures when mounting a sign to a solid wall.

What is needed, therefore, are systems and techniques for mounting signs that resist removal or damage to the sign by non-authorized persons. Such a system should be simple and easy to install.

SUMMARY OF THE INVENTION

One embodiment of the present invention provides a system for mounting signs, the system comprising: a mounting block comprising: a sign interfacing boss configured to be received into an aperture in a fence having an anterior surface and posterior rim; the anterior surface being configured to be attached to a sign; and a flange disposed about the posterior rim.

Another embodiment of the present invention provides such a system wherein the system further comprises a plurality of the mounting blocks.

A further embodiment of the present invention provides such a system wherein the system further comprises a mechanical fastener whereby the sign is affixed to the anterior surface of the block.

Yet another embodiment of the present invention provides such a system wherein the boss is configured with at least one aperture disposed within the anterior surface.

A yet further embodiment of the present invention provides such a system further comprising a posterior surface disposed on the reverse of the anterior surface.

Still another embodiment of the present invention provides such a system wherein at least one nut rotation stopping protrusion disposed on the posterior surface and proximate to at least one aperture through the anterior and posterior surfaces.

A further embodiment of the present invention provides such a system further comprising a bolt inserted through the aperture.

A still further embodiment of the present invention provides such a system wherein the bolt is a tamper resistant bolt.

A yet further embodiment of the present invention provides such a system wherein the aperture is configured in a shape selected from the group of shapes comprising circles, rectangles, oblongs, ovals, semicircles, squares, and crescents.

An even further embodiment of the present invention provides such a system wherein the at least one aperture comprises a plurality of apertures.

One embodiment of the present invention provides such a system wherein the aperture is an elongate hole arranged between opposing corners of the block.

Another embodiment of the present invention provides such a system wherein the block comprises a material selected from the group of materials consisting of sheet metal, cast metal, machined metal, molded plastic, machined plastic, and fiber glass.

A further embodiment of the present invention provides such a system wherein the boss is configured in a geometry selected from a group of geometries consisting of square, rectangular, circular, oval, and polyhedral.

Still another embodiment of the present invention provides such a system further comprising an adhesive applied to the anterior surface.

One embodiment of the present invention provides a mounting block, the block comprising: a boss; the boss comprising an anterior surface for the reception of a mountable structure, a posterior surface on the reverse of the anterior surface, and a collar disposed around the periphery of the boss and extending posteriorly from the posterior surface; and a flange disposed about the posterior periphery of the collar.

Another embodiment of the present invention provides such a system wherein the boss is configured to be inserted into interwire spaces in a chain link fence.

A further embodiment of the present invention provides such a system further comprising at least one aperture disposed through the anterior surface and the posterior surface.

One embodiment of the present invention provides a method for mounting a structure on a first side of chain link fence, the method comprising: placing the structure in contact with the first side of the fence; aligning a hole disposed in the structure with an aperture disposed in a boss of a mounting block; inserting a mechanical fastener through the hole and the aperture; inserting the boss through a gap between wires of a chain link fence from a second side of the chain link fence, such that a flange prevents the boss from sliding through the gap while permitting the boss to protrude through the fence to the first side; placing a nut on the second side of the fence with an aperture in the boss such that the nut is proximate to a nut rotation stopper; tightening the mechanical fastener such that the nut contacts the nut rotation stopper.

Still another embodiment of the present invention provides such a system further comprising inserting a plurality of the mounting blocks into the fence and fastening the structure to the plurality of blocks.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

As illustrated in FIGS. 1-9, various embodiments of the claimed invention are known. In some embodiments, a sign mounting block 10 is generally configured having a boss 12 about which is disposed a flange 14. The boss 12 is configured such that it has a flat surface some distance from the flange 14.

Figure 1:
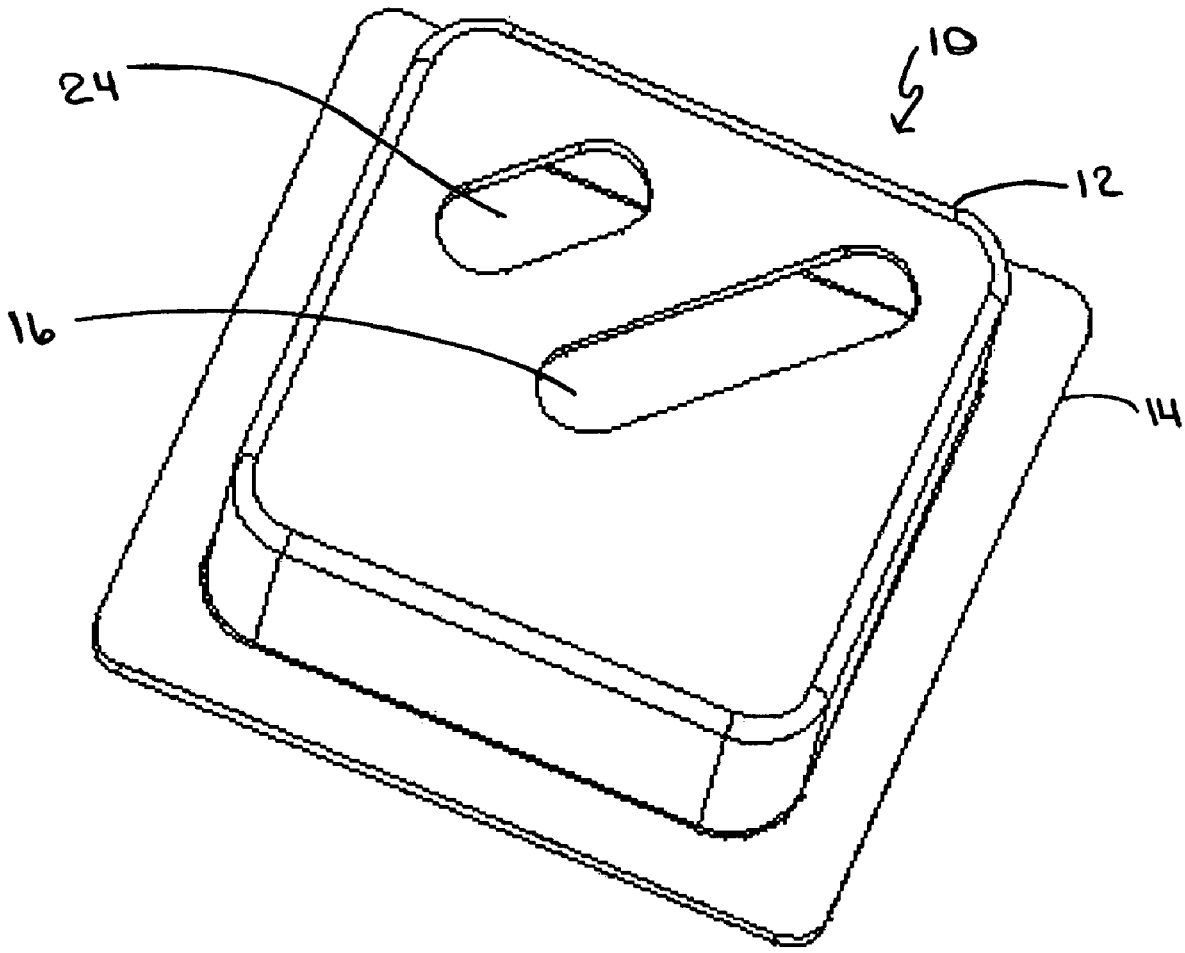
FIG. 1 is a perspective view illustrating a mounting block configured in accordance with one embodiment of the present invention.
Figure 2:
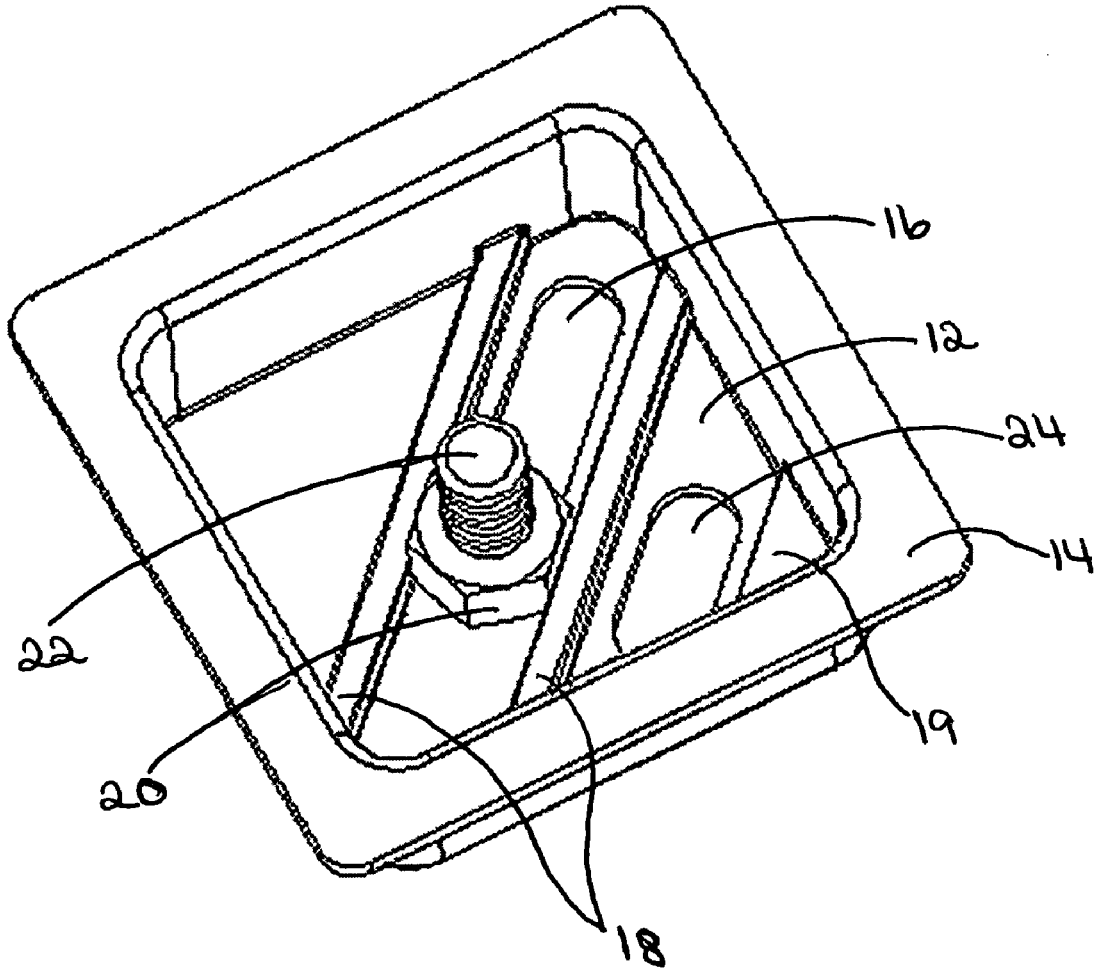
FIG. 2 is a perspective view illustrating the reverse side of the mounting block illustrated in FIG. 1 wherein a bolt and nut are also illustrated and configured in accordance with one embodiment of the present invention.

In one embodiment illustrated in FIGS. 1 and 2, the surface of the boss 12 is of a substantially square geometry adapted to be received in the gaps in chain link fences. In such an embodiment, the flange 14 protrudes from the side of the boss such that it is broader than the opening of a chain link fence into which the boss 12 is inserted. The shape and size of the boss 12 is adaptable to various shapes and sizes of chain link fences.

Also in this embodiment, at least one hole or slot 16 is disposed in the boss 12 for receiving a bolt, screw, or other mechanical fastener 22. Additional fastening may be provided by the application of an adhesive, epoxy, or double sided adhesive tape to the surface of the boss 12, thereby affixing the boss 12 to the sign (not shown).

As illustrated in FIG. 2, a nut locking structure may be incorporated into the reverse of the boss. This structure in one embodiment comprises at least one molded ridge or bar 18 incorporated into the reverse surface of the boss 12. This bar 18 is disposed proximate to the hole or slot 16 in the boss 12, such that a nut 20, into which a bolt 22 passing through the slot 16 is inserted, is prevented from rotation. In one embodiment, a height of the bar 18 not only prevents rotation of the nut 20 but also prevents the nut 20 from being removed as it is inaccessible due to the bars 18. A height of the bar 18 can be varied depending upon the height of the nut 20.

In some embodiments the bar 18 may be disposed on one side of the slot 16, while in other embodiments the bar 18 may be disposed on both sides of the slot 16. Still other embodiments include a bar 18 on one or more ends of the slot 16.

Other locking mechanisms could also be used to effectively prevent the rotation of a nut 20 used to secure a bolt 22. Examples include collars, and tabs. Alternatively, there may be raised boss sections 19 in selected interior sections of the boss 12 that may be thicker such that nut 20 is received into a hollowed out channel or cavity about the slot 16 that will prevent rotation of the nut 20.

One or more holes or slots 16, 24 may be disposed in the boss 12. These slots or holes 16, 24 may be configured in a variety of ways to receive a bolt 22. The plurality of slots 16, 24 also facilitate the alignment of the slot 16, 24 with apertures in the sign through which the bolt 22 is inserted. Example of slot shapes include but are not limited to circles, ovals, rectangles, oblongs, crosses, crescents, arcs, and semicircles.

Referring again to FIG. 1 and FIG. 2, the boss 12 can have a central slot 16 and one or two side slots 24. The bars 18 or raised boss sections 19 can be used to capture the nut 22 that is secured in the side slots 24. In one embodiment, a fastener such as a nut 20 and bolt 22 are secured in both the central slot 16 and the side slot 24 such that the sign is more securely fastened.

As is readily apparent, the attachment mounting blocks 10 are generally secured to the existing holes or apertures (not shown) of the signs. There are various sign configurations that can readily implement the mounting blocks using such pre-existing sign holes. Alternatively, the signage can be modified to support fastening with the block 10.

Figure 3:
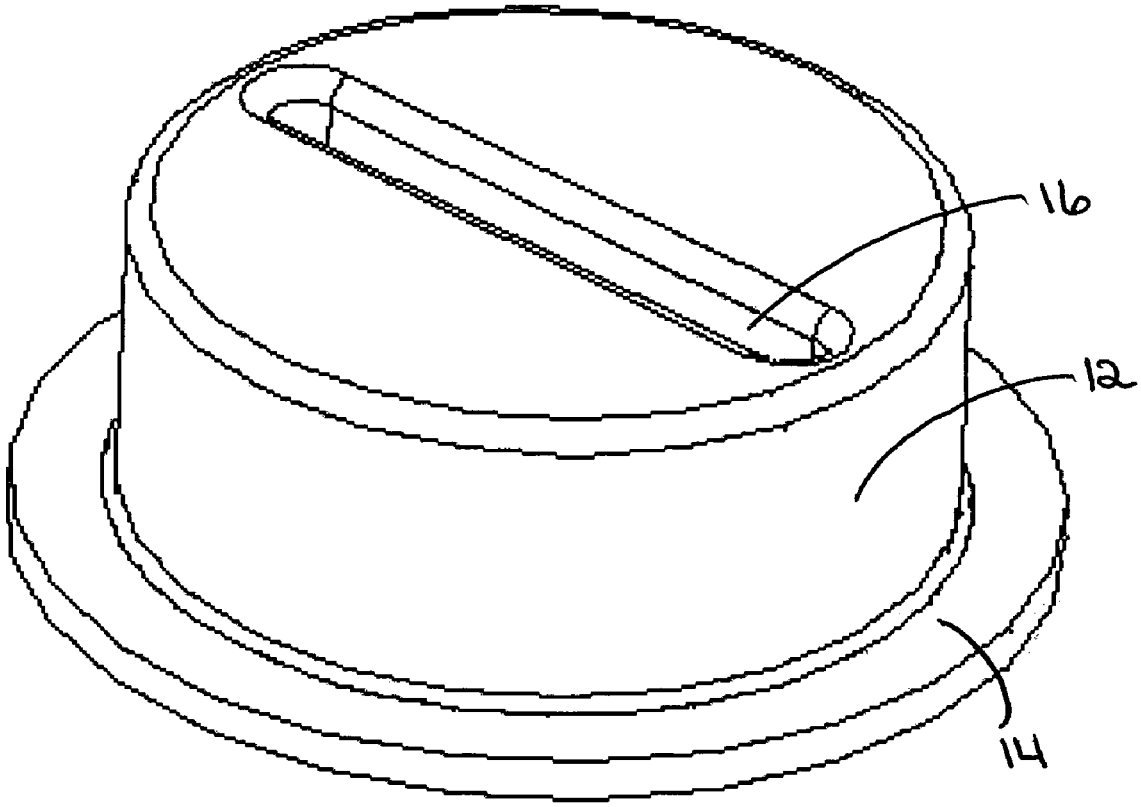
FIG. 3 is a perspective view illustrating a mounting block configured in accordance with one embodiment of the present invention having a circular cross section.

As illustrated in FIG. 3, alternative configurations for the boss 12 may be provided, among them, a circular configuration. Such a configuration may be provided with a slot or hole 16 through which a bolt 22 may be disposed to secure a sign to the mounting block 10. Alternative configurations may include various polygonal shapes. For use with chain link fencing, the boss 12 should be of sufficiently small diameter to permit its introduction into gaps in the fence, and the flange 14 should be broad enough to prevent slippage of the block 10 through the fence. In solid wall installations, this is less critical, but a broad flange 14 will allow the user to apply adhesive to a broader surface, thereby improving adhesion, and the depth of the boss 12 will provide an offset from the wall.

Figure 4:
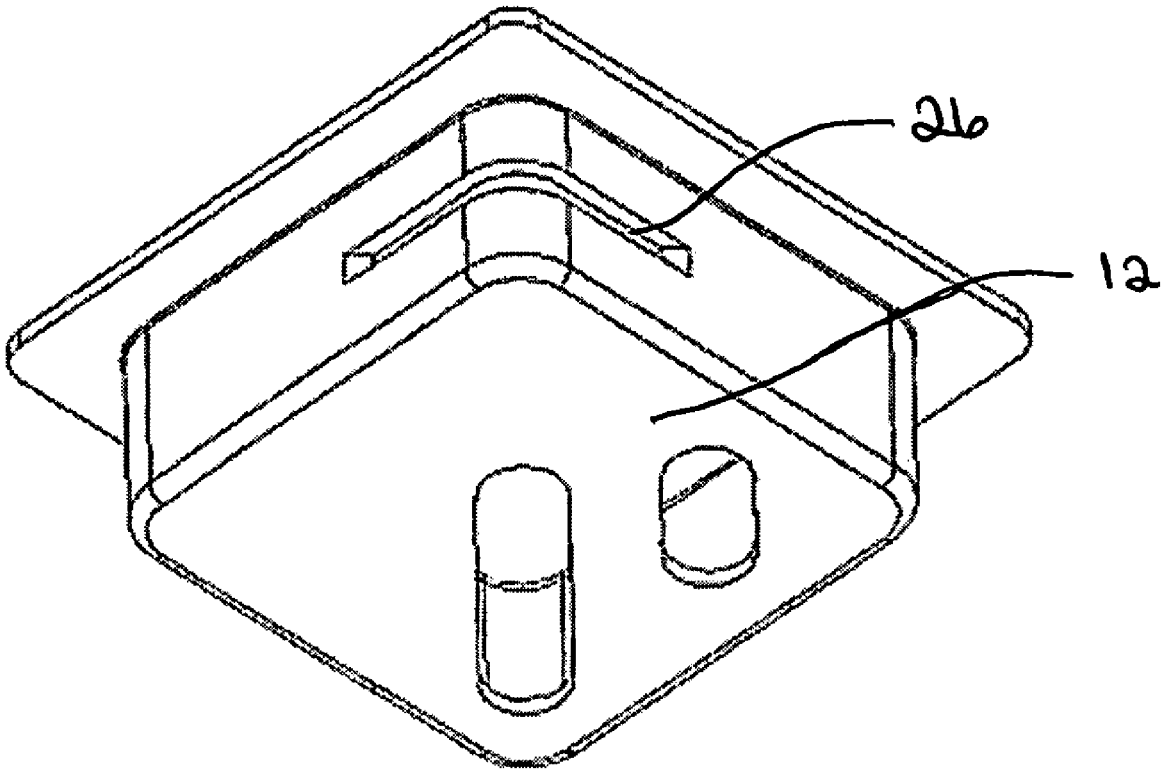
FIG. 4 is a perspective view illustrating a mounting block configured in accordance with one embodiment of the present invention having a side locking slot.

Some alternative configurations, such as that illustrated in FIG.4, provide at least one additional aperture, slot or groove 26. This additional slot 26 is disposed parallel to the surface of the boss 12 upon the side of the boss 12 and transects one corner of the boss 12. This slot 26 is configured to engage a hanging wire or hook which would wrap around the bolt, and from which a mounted structure might depend, so as to allow the mounted structure to be hung like a picture. Alternative one or more such slots 26 may be used as a chain link interfacing slot disposed at a corner of the boss 12 and configured to receive at least one wire from the fence. In one embodiment four such slots 26 may allow the boss 12 to be rotated one quarter turn and locked in place.

One skilled in the art will readily appreciate that a variety of materials may be employed in the construction of mounting block configured in accordance with the claimed invention. Examples of acceptable materials include galvanized steel, cast white metal alloys; cast zinc, cast aluminum, plastic, epoxies, and fiber glass. Plastic blocks may contain additives to improve resistance to temperature fluctuations and Ultraviolet radiation. Other possible materials may include carbon reinforced materials or stainless steal.

Figure 5:
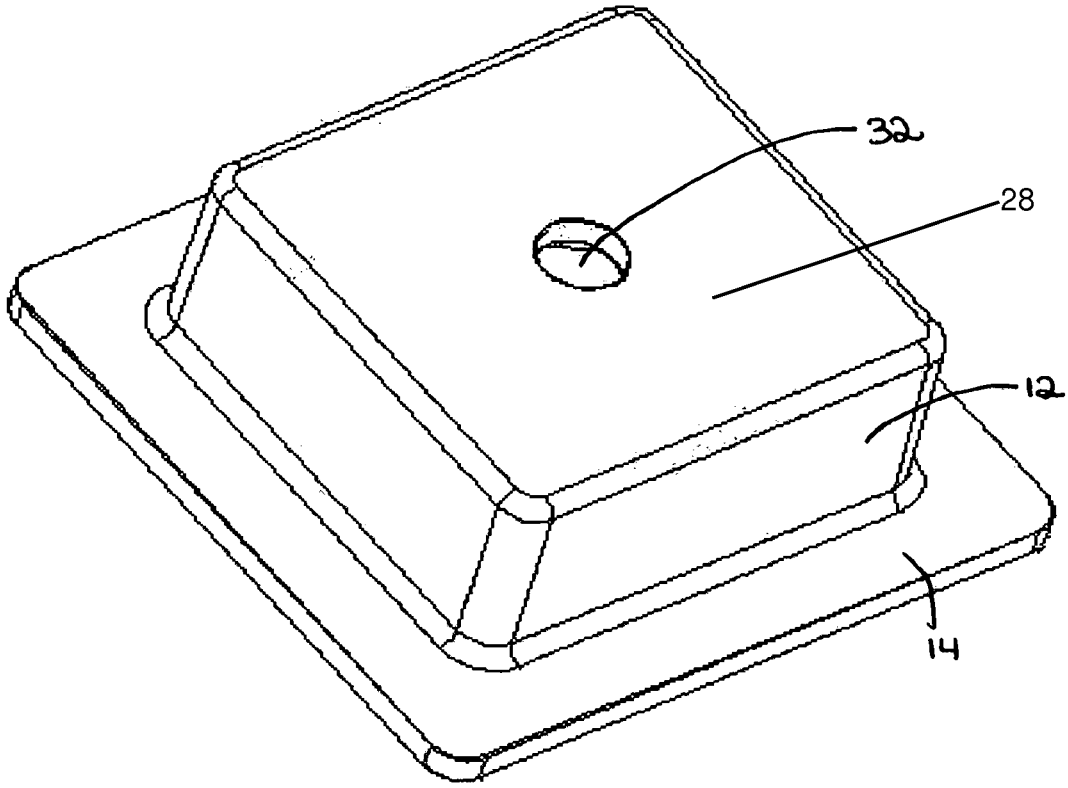
FIG. 5 is a perspective view illustrating a mounting block configured in accordance with one embodiment of the present invention having a circular aperture.
Figure 6:
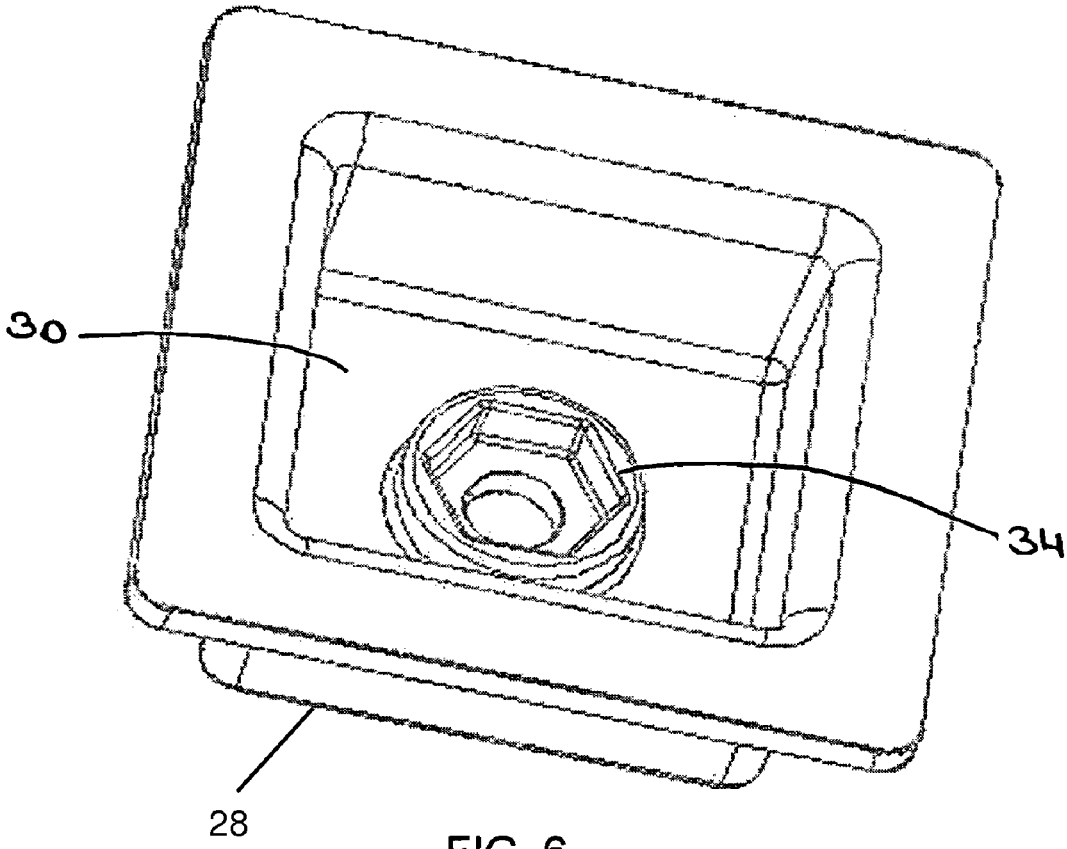
FIG. 6 is a perspective view illustrating a mounting block configured in accordance with one embodiment of the present invention having a hexagonal nut locking structure.

A further embodiment of the present invention is depicted in FIG. 5 and FIG. 6. This system for mounting signage comprises a mounting block 10 with a sign interfacing boss 12 configured to be received into gap in a fence (not shown) having an anterior surface 28 and posterior rim 30. The anterior surface 28 being configured to be attached to a sign (not shown) and having a flange 14 disposed about the posterior rim 30. On the anterior surface 28 is a hole 32 which engages a fastener, such as a bolt. The fastener is inserted into an aperture of the sign on a first side of a fence and on the second side of the fence through the hole of the boss, with a fastening mechanism such as a nut coupling the mounting block to the signage. The flange 14 secures the block 10 to the fence. The system thus couples the sign to the anterior surface 28 of the boss 12 thereby providing a simple and secure mounting.

On the posterior surface 30 is the retention mechanism 34 engaging the fastener that is inserted into the hole on the anterior surface. In this embodiment the retention mechanism 34 captivates a nut of a bolt wherein the retention mechanism 34 has a nut retention section that mates with the nut securely engaging the nut within the captivating retention mechanism 34.

Figure 7:
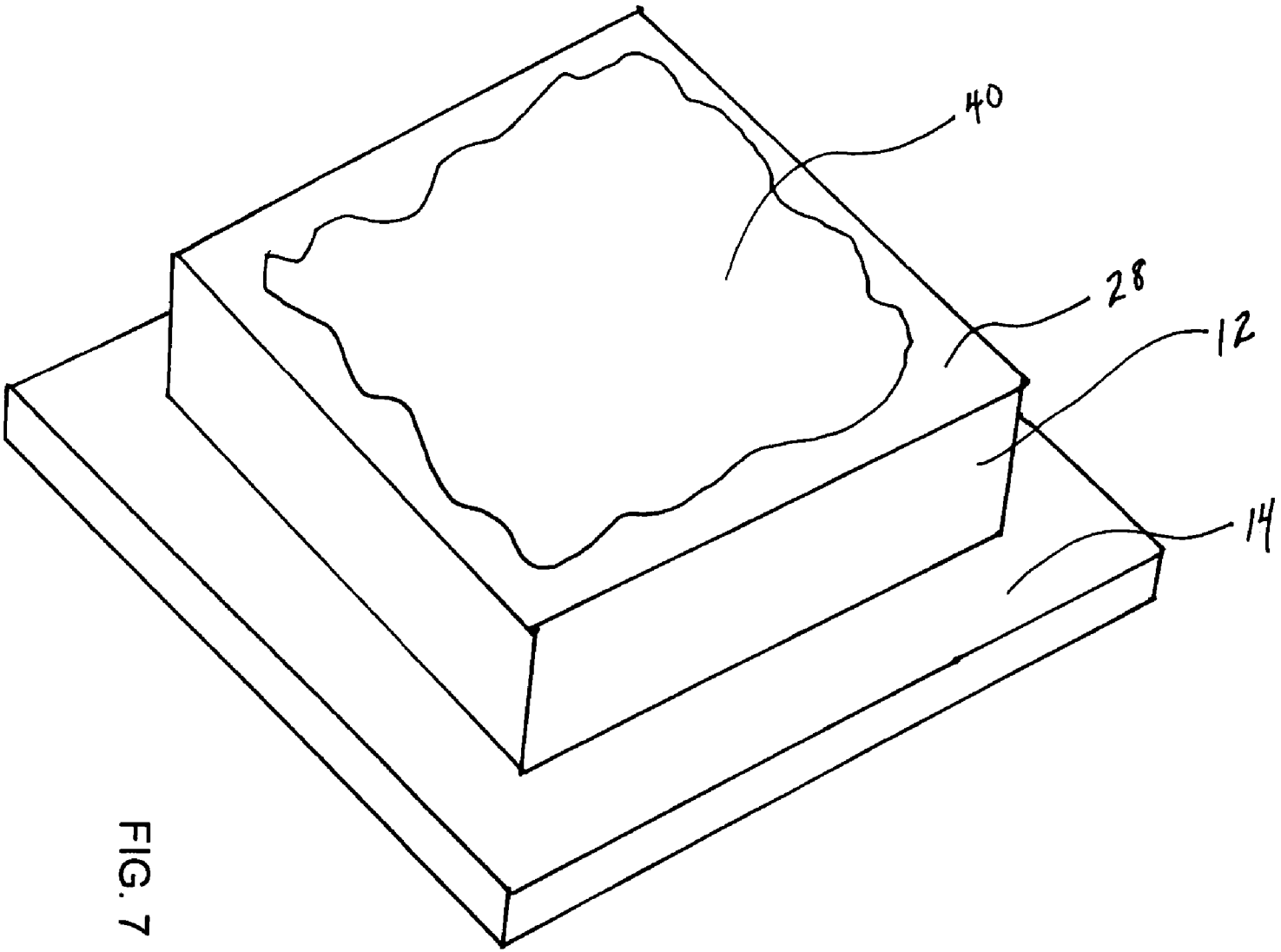
FIG. 7 is a perspective view illustrating a mounting block configured in accordance with one embodiment of the present invention having an adhesive surface.

As illustrated in FIG. 7, one embodiment of the present invention provides an adhesive 40 to be applied to the anterior surface 28 of the boss 12. Such an embodiment would be of particular use in applications where a protruding mechanical fastener is undesirable. Adhesives used may include, but are not limited to, epoxy, glue, and rubber cement.

Figure 8:
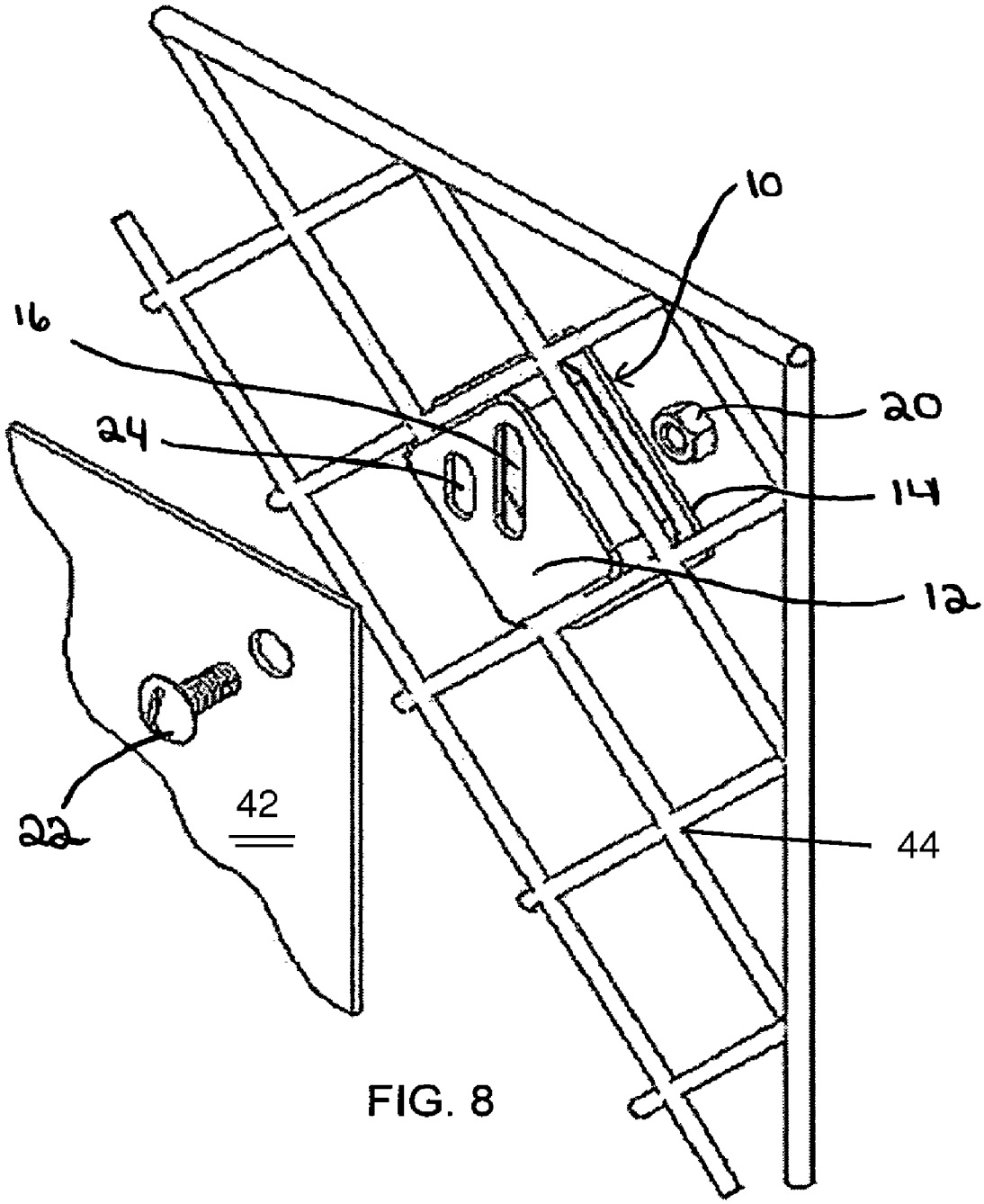
FIG. 8 is a perspective view illustrating a mounting system configured in accordance with one embodiment of the present invention.

The relationship between the components of a system configured in accordance to one embodiment of the present invention is illustrated in FIG. 8. A sign or other structure 42 is placed in contact with a chain link fence 44. The use of the term 'in contact' as used herein refers to direct or indirect contact. A mounting block 10 is placed between wires in the fence 44 such that the anterior surface 28 is proximate the sign 42. The bolt 22 is inserted through a hole in the structure 42 and through an aperture 16 in the boss 12. A nut 20 is affixed to the bolt 22 and the bolt 22 is tightened, locking the nut 20 in place. The flange 14 engages the wires of the fence and retains the block 10. The fence 44 is thus sandwiched between the structure 42 and the flange 14.

Another embodiment of the present invention provides such a system wherein the system further comprises a plurality of the mounting blocks 10. The plurality of mounting blocks is coupled to the sign, particularly large signs, such that two or more corners, sides, or peripheral edges can be secured.

A further embodiment of the present invention provides such a system wherein the system further comprises a mechanical fastener 22 such as a bolt, screw, or pin whereby the sign is affixed to the anterior surface of the block 10 by the fastener 22.

Yet another embodiment of the present invention provides such a system wherein the boss 12 is configured with at least one aperture 16 disposed within the anterior surface. The aperture can be one or more holes, slots or other openings that permit fastening of the sign to the anterior surface of the boss 12.

A yet further embodiment of the present invention provides such a system further comprising a posterior surface disposed on the reverse of the anterior surface. The posterior surface comprises the same number and type of holes or openings as on the anterior surface. The posterior surface employs retention mechanisms such that fasteners inserted through a sign aperture and then into the hole on the anterior surface can be secured by a securing mechanism of the posterior surface.

Still another embodiment of the present invention provides such a system wherein there is at least one securing mechanism 18 disposed on the posterior surface and proximate to at least one aperture 16 through the anterior and posterior surfaces. The securing mechanism can be a nut retention stopper for securely captivating a nut of a bolt. For example, ribs or bars 18 on one or more sides of the hole 32 or slot 16. Other securing mechanisms include threaded collars and similar fastening devices as known in the art.

A further embodiment of the present invention provides such a system further comprising a bolt 22 inserted through the aperture. A still further embodiment of the present invention provides such a system wherein the bolt 22 is a tamper resistant bolt. A tamper resistant bolt is one in which the bolt is not easily removed. The head of the bolt may be designed such that a special tool is required for extraction. Other bolts have break-away heads or adhesive coatings that make removal difficult for vandals.

A yet further embodiment of the present invention provides such a system wherein the aperture 16 is configured in a shape selected from the group of shapes comprising circles, rectangles, oblongs, ovals, semicircles, squares, and crescents.

An even further embodiment of the present invention provides such a system wherein there is a plurality of apertures 16, 24. One embodiment of the present invention provides such a system wherein the aperture 16 is an elongate hole arranged between opposing corners of the block.

Another embodiment of the present invention provides such a system wherein the block 10 comprises a material selected from the group of materials consisting of sheet metal, cast metal, plastic, and fiber glass.

A further embodiment of the present invention provides such a system wherein the boss 12 is configured in a geometry selected from a group of geometries consisting of square, rectangular, circular, oval, and polyhedral.

Still another embodiment of the present invention provides such a system further comprising an adhesive applied to the anterior surface. The adhesive secured the anterior face of the boss that extends through the fence with the flange retaining the signage or other mounted structure. The adhesive boss embodiment can be used in combination with other mounting blocks 10, especially where the alignment of apertures in the sign are not convenient for mounting with the fence.

One embodiment of the present invention provides a mounting block, the block 10 comprising a boss 12, wherein the boss 12 comprises an anterior surface for the reception of a mountable structure. There is a posterior surface on the reverse of the anterior surface, and a collar disposed around the periphery of the boss and extending posteriorly from the posterior surface. A flange 14 is disposed about the posterior periphery of the collar. The collar is, in one embodiment an extension of the boss 12 away from the anterior surface and surrounding the posterior surface.

Another embodiment of the present invention provides such a system wherein the boss 12 is configured to be inserted into interwire spaces, i.e. those spaces, often of diamond shape, between wires in a chain link fence.

A further embodiment of the present invention provides such a system further comprising at least one aperture 16, 24 disposed through the anterior surface and the posterior surface.

Figure 9:
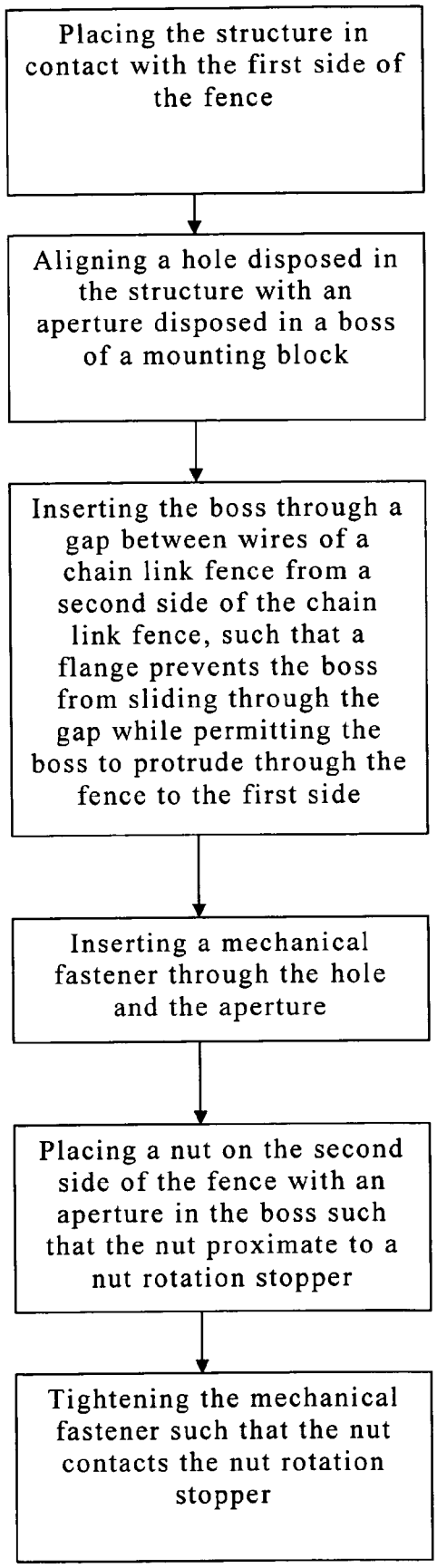
FIG. 9 is a flow chart illustrating a method for mounting a structure on a chain link fence in accordance with one embodiment of the present invention.

One embodiment of the present invention, illustrated in FIG. 9, provides a method for mounting a structure on a first side of chain link fence, the method comprising placing the structure in contact, either direct or indirect, with the first side of the fence; aligning a hole disposed in the structure with an aperture disposed in a boss of a mounting block; inserting a mechanical fastener through the hole and the aperture; inserting the boss through a gap between wires of a chain link fence from a second side of the chain link fence, such that a flange prevents the boss from sliding through the gap while permitting the boss to protrude through side fence to the first side; placing a nut on the second side of the fence with an aperture in the boss such that the nut proximate to a nut rotation stopper; tightening the mechanical fastener such that the nut contacts the nut rotation stopper. One skilled in the art will appreciate that other orders may be employed based on personal preference.

Still another embodiment of the present invention provides such a system further comprising inserting a plurality of the mounting blocks into the fence and fastening the structure to the plurality of blocks.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A system for mounting signs, said system comprising: a mounting block comprising:

a sign interfacing boss configured to be received into an aperture in a fence having an anterior surface and posterior rim;

said anterior surface being configured to be attached to a sign;

a flange disposed about said posterior rim; a posterior surface disposed on the reverse of said anterior surface;

at least one nut rotation stopping protrusion disposed on said posterior surface and proximate to at least one aperture through said anterior and posterior surfaces; and wherein said aperture is an elongate hole arranged between opposing corners of said block.

2. The system of claim 1 wherein said system further comprises a plurality of said mounting blocks.

3. The system according to claim 1 wherein said system further comprises a mechanical fastener whereby said sign is affixed to said anterior surface of said block.

4. The system according to claim 1 wherein said boss is configured with at least one aperture disposed within said anterior surface.

5. The system according to claim 1, further comprising a bolt inserted through said aperture.

6. The system according to claim 5 wherein said bolt is a tamper resistant bolt.

7. The system according to claim 1 wherein said aperture is configured in a shape selected from the group of shapes consisting circles, rectangles, oblongs, ovals, semicircles, squares, and crescents.

8. The system according to claim 1 wherein said at least one aperture comprises a plurality of apertures.

9. The system according to claim 1 wherein said block comprises a material selected from the group of materials consisting of sheet metal, cast metal, plastic, epoxies, and fiber glass.

10. The system according to claim 1 wherein said boss is configured in a geometry selected from a group consisting of square, rectangular, circular, oval, and polyhedral.

11. The system according to claim 1 further comprising an adhesive applied to said anterior surface.

12. The system according to claim 1 further comprising at least one chain link interfacing slot disposed at a corner of said boss and configured to receive at least one wire from said fence.

13. A mounting block, said block comprising:

a boss;

said boss comprising an anterior surface for the reception of a mountable structure, a posterior surface on the reverse of said anterior surface, and a collar disposed around a periphery of said boss and extending posteriorly from said posterior surface;

a flange disposed about the posterior periphery of said collar;

at least one nut rotation stopping protrusion disposed on said posterior surface and proximate to at least one aperture through said anterior and posterior surfaces.

14. The mounting block according to claim 13, wherein said boss is configured to be inserted into interwire spaces in a chain link fence.

15. A method for mounting a structure on a first side of chain link fence, said method comprising:

placing said structure in contact with said first side of said fence;

aligning a hole disposed in said structure with an aperture disposed in a boss of a mounting block;

inserting a mechanical fastener through said hole and said aperture;

inserting said boss through a gap between wires of a chain link fence from a second side of said chain link fence, such that a flange prevents said boss from sliding through said gap while permitting said boss to protrude through said fence to said first side;

placing a nut on said second side of said fence with an aperture in said boss such that said nut proximate to a nut rotation stopper;

tightening said mechanical fastener such that said nut contacts said nut rotation stopper.

16. The method according to claim 15 further comprising inserting a plurality of said mounting blocks into said fence and fastening said structure to said plurality of blocks.

* * * * *